United States Patent [19]

Cusano et al.

[11] 4,161,392

[45] Jul. 17, 1979

[54] NITROGEN CONTAINING POLYMERS PREPARED FROM METHACRYLIC ESTERS AS CARBURETOR DETERGENTS AND CORROSION INHIBITORS

[75] Inventors: Carmen M. Cusano, Poughkeepsie; Isaac D. Rubin, Wappingers Falls; Ronald E. Jones, Glenham; Paul F. Vartanian, Wappingers Falls, all of N.Y.

[73] Assignee: Texaco Inc., New York, N.Y.

[21] Appl. No.: 847,643

[22] Filed: Nov. 1, 1977

[51] Int. Cl.[2] ..... C10L 1/22

[52] U.S. Cl. ..... 44/62; 526/312; 526/265

[58] Field of Search ..... 44/62; 526/312, 265

[56] References Cited

U.S. PATENT DOCUMENTS

| | | | |
|---|---|---|---|
| 2,737,452 | 3/1956 | Catlin et al. | 44/62 |
| 2,805,925 | 9/1957 | Biswell | 44/62 |
| 3,934,595 | 1/1976 | Dermain | 526/312 |
| 4,036,768 | 7/1977 | Crawford | 526/312 |

*Primary Examiner*—Winston A. Douglas
*Assistant Examiner*—Y. Harris-Smith
*Attorney, Agent, or Firm*—Thomas H. Whaley; Carl G. Ries; James J. O'Loughlin

[57] ABSTRACT

A copolymer comprising the olefin polymerization product of:

A. a $C_1$–$C_6$ saturated or unsaturated, substituted or unsubstituted, aliphatic or aromatic ester of an unsaturated aliphatic mono-, di- or polycarboxylic acid of chain length $C_1$ to $C_6$ in the amount of between 5 and 30 weight percent;

B. a $C_8$–$C_{20}$ saturated or unsaturated, substituted or unsubstituted, aliphatic or aromatic ester of an unsaturated mono-, di- or polyaliphatic carboxylic acid of chain length $C_1$ to $C_6$ in the amount of 5 to 81 percent by weight; and C. an ethylenically unsaturated compound containing a basic nitrogen in a side chain.

14 Claims, No Drawings

NITROGEN CONTAINING POLYMERS PREPARED FROM METHACRYLIC ESTERS AS CARBURETOR DETERGENTS AND CORROSION INHIBITORS

BACKGROUND OF THE INVENTION

1. Field of the Invention

This invention relates to a new copolymer comprising units of an ester of an unsaturated aliphatic carboxylic acid and units of an ethylenically polymerizable comonomer having, in a side chain which is not part of the polymer chain, at least one amino group. This invention relates to such copolymers and their use as detergents in motor fuels, especially gasoline.

2. Discussion of the Prior Art

Numerous detergents for inclusion in fuels have heretofore been suggested. For instance, it has long been known to include in gasoline a detergent based upon an amine such as a condensation product of a secondary amine with an anhydride such as maleic anhydride. Other known detergents include materials such as polyisobutyl amines. Unfortunately, while effective, these known detergents are quite expensive, thus raising the overall price of the gasoline. It became desirable to provide a detergent which can be synthesized at substantially less cost and is similarly effective in providing detergency in the lines through which the fuels pass. It became particularly desirable to provide a detergent for gasoline which would remove deposits in the carbutetor of an automobile and, at the same time, would prevent deposit buildup on such carburetor.

Stabilized fuels have been proposed containing copolymers made from esters of unsaturated carboxylic acids. Thus, Catlin et al disclosed in U.S. Pat. No. 2,737,452, a stabilized fuel containing an oil soluble basic amino nitrogen-containing addition type polymer made from a plurality of polymerizable olefinically unsaturated compounds. One of the components is amine-free and contains 8 to 18 carbon atoms in an aliphatic hydrocarbon chain which, while in the polymer, is not part of the main polymer chain. The other component of the polymer is a comonomer which contains a basic amino nitrogen in a side chain. Such copolymer is included in a fuel oil in a small proportion, i.e., at least about 0.001 percent by weight and acts as a stabilizer therein. The copolymer of Catlin et al necessarily has units of at least 8 carbon atoms in the ester chain, for Catlin et al discloses that polymers of aminoethylmethacrylate (where the chain length is far less than 8 carbon atoms) are without effect in the formation of sediment in fuel oils even when such homopolymers contain long hydrocarbon chains.

Undoubtedly, the Catlin et al stabilizer is effective for stabilizing catalytically cracked fuel oils. It has become desirable, however, to provide a stabilizer derived from an ester of a carboxylic acid and a nitrogen containing comonomer thereof which is especially effective to remove the buildup of deposits on an engine carburetor.

SUMMARY OF THE INVENTION

In accordance with this invention, an inexpensive stabilizer which is effective as a detergent to remove deposit buildup from a carburetor, is provided by a copolymer comprising the olefin polymerization product of:

A. a $C_1$–$C_6$ saturated or unsaturated, substituted or unsubstituted, aliphatic or aromatic ester of an unsaturated aliphatic mono-, di- or polycarboxylic acid of chain length $C_1$ to $C_6$ in an amount of between 5 and 30 weight percent;

B. a $C_8$–$C_{20}$ saturated or unsaturated, substituted or unsubstituted, aliphatic or aromatic ester of an unsaturated mono-, di- or polyaliphatic $C_1$ to $C_6$ carboxylic acid in the amount of 50 to 81 weight percent; and C. an ethylenically unsaturated compound containing a basic nitrogen in a side chain.

In accordance with the invention, it has been discovered that an improved gasoline detergent is provided if the copolymer contains units derived from an ester whose ester group contains only up to 6 carbon atoms. It has been surprisingly found that if a portion of the amine-free components of the Catlin et al stabilizer are replaced with units of shorter ester group length, that improved detergency is obtained, as will be shown below. The detergent of the invention is effective in removing up to 75 percent of the deposits on an automotive engine carburetor.

Component A is, therefore, a necessary and important component of the copolymer of the invention and is present in the copolymer in an amount of at least 5 percent by weight and up to 30 percent by weight, generally 10 to 30 percent by weight, and most preferably 15 to 25 weight percent. Component A is free of amino nitrogen.

Component B is present in an amount of 50 to 81 weight percent, preferably 60 to 75 weight percent.

Component C usually makes up the balance of the polymer and can be present in an amount of 4 to 20 percent by weight, preferably 7 to 20 weight percent.

Component A and Component B can be made from the same acids or different acids, the components differing in the length of the ester group. They can be made from mono-, di- or polyaliphatic carboxylic acids of $C_1$ to $C_6$ chain length. Particularly contemplated acids include methacrylic acid, acrylic acid, fumaric acid, maleic acid and butenic acid. Where substituted esters are employed, the substituents on the ester group can be halogen, cyano, hydroxy, thiohydroxy and acetyl. The amount of any halo substituent and of sulfur is, of course, limited by recognized upper limits for these materials.

With respect to the nature of the ester group of the carboxylic acid esters, it is preferred that the ester group be an alkyl group. However, the ester function can be an alkenyl group, an alkynyl group, an alkylaryl group, a cycloalkyl group. Thus, the ester group can be virtually and cyclic or alicyclic group. When the ester group is an aromatic group, it is preferably phenyl. Preferably, it is phenyl in the case of Component A, but in respect of Component B, it can be phenyl, naphthyl or biphenyl. Where phenyl, it can be substituted with an alkyl group having up to 8 carbon atoms.

The copolymer of the invention has a molecular weight between 500 and 4,000, the molecular weight being determined by vapor phase osmometry. Preferably, the molecular weight of the copolymer is between 1,000 and 3,500. Component B, a non-nitrogen containing unsaturated carboxylic acid ester, is preferably formed of a mixture of unsaturated carboxylic acid esters where a first component comprises esters having between 16 and 20 carbon atoms in chain length and a second component comprises esters of 12 to 15 carbon atoms in the ester group. The first component is preferably present in the copolymer in an amount between 10 and 25 weight percent, preferably 15 to 20 weight percent, while the second component is preferably present in an amount of 40 to 60 weight percent, especially 50 to 55 weight percent. By employing such high molecular weight esters in combination with the lower molecular weight esters of Component A, a highly effective fuel oil detergent is provided.

The nitrogen-containing component, Component C, can be any of those heretofore known for use in stabilizers for motor fuels. These include, in particular, those ethylenically unsaturated compounds which contain a basic amino nitrogen in a side chain which will supply said nitrogen in an amount of 0.3 percent to 3.5 percent by weight to the overall polymer. Comonomers supplying such nitrogen include, in particular, primary, secondary and tertiary unsaturated amines, as well as compounds containing nitrogen in an aromatic or heterocyclic ring. Introduction of the basic amino nitrogen structure can be accomplished by the use of at least one monomeric component containing the amino group or by use of a monomer containing a group which is reactive, when present in the polymer, with ammonia or primary or secondary non-aromatic amines. Particular examples of basic amino-containing comonomers include the basic amino substituted olefins such as p-(β-diethylaminoethyl)styrene; basic nitrogen-containing heterocyclics carrying a polymerizable ethylenically unsaturated substituent such as the vinyl pyridines and the vinyl alkyl pyridines such as 2-vinyl-5-ethyl pyridine; esters of basic amino alcohols with unsaturated carboxylic acids such as the alkyl and cycloalkyl substituted amino alkyl and cycloalkyl esters of the acrylic and alkacrylic acids, e.g., β-methylaminoethylacrylate, 4-diethylaminocyclohexyl methacrylate, β,β-didodecylaminoethylacrylate and the like; unsaturated ethers of basic amino alcohols such as the vinyl ethers of such alcohols, for example β-aminoethylvinyl ether, β-diethylaminoethylvinyl ether and the like; amides of unsaturated carboxylic acids wherein a basic amino substituent is carried on the amide nitrogen such as N-(β-dimethylaminoethyl)acrylamide; polymerizable unsaturated basic amines, for example, diallyl amine and the like. The term "basic amino nitrogen", as used in the specification and in the appended claims, is used in the generic sense to cover the primary, secondary and tertiary amines including, as above-recited, the basic nitrogen-containing heterocyclics.

The preferred amines include the polymerizable, ethylenically unsaturated compounds having a basic tertiary amino group. Particularly outstanding amines are 4-vinyl-pyridine and dimethylaminoethyl methacrylate.

Component C is present in the polymer generally in an amount from 2 to 20 percent by weight whereby to supply the polymer with 0.1 to 3.5 weight percent nitrogen.

Copolymers useful in the practice of the invention can be prepared by conventional bulk, solution or dispersion polymerization methods involving use of known initiators, including oxygen-yielding compounds such as benzoyl peroxide and azo compounds such as azoisobutyronitrile. Another useful initiator is di-t-butylperoxide. The polymerization is generally carried out in an inert atmosphere, such as an atmosphere of nitrogen or carbon dioxide, at a temperature ranging from 30° to 150° C., depending on the catalyst used, and generally at temperatures between 50° and 70° C. when azoisobutyronitrile free radical initiator is employed. It is important to carry out the copolymerization to substantial completion so that no unpolymerization monomers remain in the product.

The copolymer of the invention is useful in fuel oils, especially gasoline. When employed, it is included in the fuel in an amount between 0.005 and 1.0 weight percent, preferably 0.05 to .75 weight percent.

In order to more fully illustrate the nature of the invention and the manner of practicing the same, the following examples are presented:

EXAMPLES

EXAMPLE 1

Into a one liter resin kettle fitted with external heating, thermometer, nitrogen inlet, stirrer and condenser, there was charged 272 grams of a commercially available long chain ester of methacrylic acid where the ester chain was between 12 and 15 carbon atoms in length with an average chain length of 13.6. A material identified as Neodol 25L methacrylate supplied such esters. The resin kettle was additionally charged with 82 grams of commercially available longer chained ester of methacrylic acid which supplied esters of 16 to 20 carbon atom length with average chain length of 17.7. Alfol 1620 methacrylate supplied such esters. The Neodol 25L and Alfol 1620 together made up the Component B. The resin kettle was supplied with 100 grams of n-butylmethacrylate which supplied Component A. Component C was supplied by 45 grams of dimethylaminoethyl methacrylate. Into the reaction mixture was also introduced 5 grams of n-dodecylmercaptan. The reaction mixture was heated to 95° C. under a nitrogen atmosphere and 0.4 grams of azobisisobutyronitrile initiator was added. The progress of the polymerization was followed by determining the refractive index of samples. Additional azobisisobutyronitrile in the amount of 0.2 grams and 0.1 grams was added after 2 hours and 3½ hours of heating respectively. Heating was continued for a total of 6 hours at 95° to 100° C. A product was obtained having only 0.6 percent residual monomer. The same was tested to determine its effect in removing deposit of buildup according to the Chevrolet Carburetor Detergency Test described below.

Other copolymers were prepared using varying amounts of aminonitrogen-containing component (Component C). The polymers were prepared in accordance with the manipulative procedure described above.

The ability of the additives to remove preformed deposits from the throttle plate of a carburetor was tested in the Chevrolet Carburetor Test, Phase III. This test was run using a Chevrolet V8 engine mounted on a test stand and fitted with a modified four barrel carburetor. The two secondary barrels of the carburetor were sealed and the feed to each of the primary barrels was arranged so that the detergent additive fuel could run in one barrel and the reference fuel could run in the other. The primary carburetor barrels were also modified to contain removable aluminum inserts in the throttle plate area so that the deposits adhering to the inserts could be conveniently weighed.

The engine was run for a period of time, usually 24 or 48 hours, using base fuel as the feed to both carburetor barrels with engine blowby circulated to the carburetor air inlet. The weight of the deposits thus formed was measured and recorded. Upon completion of the test cycle, the inserts were removed from the carburetor and the relative efficacy of the stabilizer determined.

The results obtained were averaged and the efficacy of the additive fuel in removing deposits was expressed in percent.

The efficacy of the various stabilizers is shown in Table I, below.

TABLE I

| EXAMPLE | Weight % $C_{12}$–$C_{16}$ Methacrylic Acid Esters | Weight % $C_{16}$–$C_{20}$ Methacrylic Acid Esters | Butyl Methacrylate | DMAEMA[a] | 4-Vinyl-Pyridine | DEPOSIT Buildup | DEPOSIT Removal | DEPOSIT Efficacy Percent |
|---|---|---|---|---|---|---|---|---|
| 1 | 57.5 | 17.5 | 21 | — | 4 | 20.4 | 6.3 | 31 |
| 2 | 54.5 | 16.5 | 20 | — | 9 | 18.8 | 13.4 | 71 |
| 3 | 57.5 | 17.5 | 21 | 4 | — | 19.1 | 10.5 | 55 |
| 4 | 54.5 | 16.5 | 20 | 9 | — | 19.0 | 12.5 | 66 |
| 5 | 50 | 15 | 18 | 18 | — | 21.7 | 16.2 | 75 |
| Comparative Example A | 63.7 | 21.3 | — | 15 | — | 23.8 | 7.2 | 30 |

[a]DMAEMA = dimethylaminoethylmethacrylate

From the data set forth in the table supra, it is evident that the presence of shorter chain esters remarkably improves the ability of the detergent to remove deposits from the engine carburetor. Note that where the polymer contains 9 percent by weight of components of dimethylaminoethylmethacrylic acid with 20 weight percent of units of butylmethacrylate, a 66 percent efficacy is achieved. Where, however, the polymer is free of such shorter chain esters of methacrylic acid and contains 15 weight percent dimethylaminoethylmethacrylate, the removal efficacy is only 30 percent. Thus, while the nonbutylmethacrylate-containing polymer has almost twice the amount of nitrogen-containing component, it is less than one half as effective as a polymer containing the shorter chained ester. In general, the efficacy of the shorter chained ester-containing polymer is far greater than the polymer free of such shorter chained ester.

EXAMPLE 2

The ability of the additives of the present invention to provide corrosion protection was tested in a Colonial Pipeline Rust Test. In this test, similar to ASTM D-665, a 300 ml sample of additive fuel was stirred for 3½ hours at 100° F. with 30 ml of distilled water in the presence of a polished steel spindle. At the end of the time period, the steel spindle was visually examined for signs of rust and the ratings expressed in percent of area covered by rust. Anything less than 5 percent is considered to be a passing result.

The Colonial Pipeline Rust Test further shows the ability of the stabilizer of the invention to inhibit rust formation in steel pipes.

TABLE II

| Fuel | Colonial Pipeline Rust Test[b] Additional Dosage PTB[c] | Rust, Percent |
|---|---|---|
| Base Fuel[d] | — | 50–100 |
| Base Fuel plus polymer of Example 2 | 100 | Trace-1 |
| Base Fuel plus polymer of Example 3 | 50 | 1–5 |
| Base Fuel plus polymer of Example 4 | 25 | 1–5 |
| Base Fuel plus polymer of Example 5 | 200 | Trace-1 |
| Base Fuel plus polymer of Comparative Example A | 12½ | 1–5 |

[b]ASTM D-665 as modified
[c]Pounds per thousand barrels
[d]Commercial Premium gasoline

What is claimed is:

1. A copolymer comprising the olefin polymerization product of:

A. butyl methacrylate

B. a $C_8$–$C_{20}$ saturated or unsaturated, substituted or unsubstituted, aliphatic or aromatic ester of an unsaturated mono-, di- or polyaliphatic carboxylic acid of chain length $C_1$ to $C_6$ in the amount of 5 to 81 percent by weight; and C. an ethylenically unsaturated compound containing a basic nitrogen atom in the side chain selected from the group consisting of dimethyl amino ethyl methacrylic acid and 4-vinyl pyridine.

2. A copolymer according to claim 1 wherein Component C is dimethylaminoethylmethacrylate.

3. A copolymer according to claim 1 wherein Component C is 4-vinylpyridine.

4. A copolymer according to claim 1 wherein the polymer comprises 10 to 25 weight percent of units of a $C_{16}$ to $C_{20}$ ester of $C_1$–$C_6$ unsaturated mono-, di- or polycarboxylic acids and 40 to 60 weight percent of units of a $C_{12}$ to $C_{15}$ ester of a $C_1$ to $C_6$ unsaturated mono-, di- or polycarboxylic acid.

5. A copolymer according to claim 4 containing 10 to 20 weight percent of $C_{16}$ to $C_{20}$ esters of $C_1$ to $C_6$ aliphatic mono-, di- or polycarboxylic acids and 50 to 55 weight percent of $C_{12}$ to $C_{15}$ esters of $C_1$ to $C_6$ aliphatic mono-, di- or polycarboxylic acids.

6. A copolymer according to claim 1 wherein Component C is present in an amount of 4 to 20 weight percent.

7. A copolymer according to claim 6 wherein Component C is present in an amount of 7 to 20 weight percent.

8. A copolymer according to claim 1 wherein Component A is present in an amount of 10 to 30 weight percent.

9. A copolymer according to claim 8 wherein Component A is present in an amount of 15 to 25 weight percent.

10. A copolymer according to claim 1 having a molecular weight of 500 to 4,000 determined by vapor phase osmometry.

11. A copolymer according to claim 10 having a molecular weight of 2,000 to 4,000.

12. A petroleum base fuel containing as a detergent 0.005 to 1 weight percent of the copolymer of claim 1.

13. A fuel composition according to claim 12 wherein said copolymer is present in an amount of 0.05 to 0.75 weight percent.

14. A fuel composition according to claim 12 wherein said fuel is gasoline.

* * * * *